US005802442A

United States Patent [19]

Konno et al.

[11] Patent Number: 5,802,442

[45] Date of Patent: Sep. 1, 1998

[54] INTERMEDIATE TRANSFER MEMBER, ELECTROPHOTOGRAPHY APPARATUS USING THE SAME, AND METHOD FOR MANUFACTURING THE SAME

[75] Inventors: Takuya Konno, Ibaraki-ken; Masaaki Takenaka, Kashiwa; Hitoshi Kakii; Mihoko Oda, both of Ushiku, all of Japan

[73] Assignee: Canon Kasei Kabushiki Kaisha, Japan

[21] Appl. No.: 733,013

[22] Filed: Oct. 16, 1996

[30] Foreign Application Priority Data

| | | | |
|---|---|---|---|
| Oct. 20, 1995 | [JP] | Japan | 7-272996 |
| Jul. 26, 1996 | [JP] | Japan | 8-214965 |

[51] Int. Cl.[6] ..... G03G 15/00; G03G 15/16

[52] U.S. Cl. ..... 399/308; 430/126

[58] Field of Search ..... 399/302, 308, 399/307; 430/126, 31, 902; 428/411.1, 474.4, 480

[56] References Cited

U.S. PATENT DOCUMENTS

| | | | |
|---|---|---|---|
| 4,015,027 | 3/1977 | Buchan et al. | 430/126 X |
| 4,448,872 | 5/1984 | Vandervalk | 430/126 |
| 4,588,279 | 5/1986 | Fukuchi et al. | 399/308 |
| 4,729,925 | 3/1988 | Chen et al. | 428/425.8 |
| 5,102,722 | 4/1992 | Iida et al. | 428/480 X |
| 5,149,589 | 9/1992 | Naritomi et al. | 428/480 X |
| 5,243,392 | 9/1993 | Berkes et al. | 399/308 |
| 5,409,557 | 4/1995 | Mammino et al. | 430/126 X |
| 5,438,398 | 8/1995 | Tanigawa et al. | 399/302 |
| 5,493,373 | 2/1996 | Gundlach et al. | 399/302 |
| 5,530,532 | 6/1996 | Iino et al. | 399/308 X |
| 5,600,422 | 2/1997 | Fukami et al. | 399/313 |
| 5,608,503 | 3/1997 | Fujiwara et al. | 399/302 |

FOREIGN PATENT DOCUMENTS

| | | |
|---|---|---|
| 0715229 | 6/1996 | European Pat. Off. . |
| 0726504 | 8/1996 | European Pat. Off. . |
| 59-077467 | 5/1984 | Japan . |
| 62-156682 | 7/1987 | Japan . |
| 63-301960 | 12/1988 | Japan . |
| 3-69166 U | 7/1991 | Japan . |
| 4-356082 | 12/1992 | Japan . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A belt-shaped intermediate transfer member is provided in an electrophotography apparatus, for transferring a toner image formed on a photosensitive drum to a recording medium such as paper. The intermediate transfer member includes at least a base layer and a surface layer provided upon this base layer. The base layer is formed of elastomer, and the surface layer is formed of engineering plastic such as polyether imide, polyether sulfone, polysulfone, or polyphenyl sulphone which have exceptional dimensional stability.

18 Claims, 3 Drawing Sheets

INTERMEDIATE TRANSFER MEMBER, ELECTROPHOTOGRAPHY APPARATUS USING THE SAME, AND METHOD FOR MANUFACTURING THE SAME

BACKGROUND OF THE INVENTION

1. Field of the Invention

The present invention relates to an intermediate transfer member which temporarily holds an image during an image forming process, an electrophotography apparatus using this intermediate transfer member, and a method for manufacturing the intermediate transfer member.

2. Related Background Art

Electrophotography apparatuses employing an intermediate transfer member are extremely useful in sequentially transferring and layering a plurality of component color images to form a color image. Using such an arrangement, offsetting of colors which occurs during layering of the toner images of each color can be reduced as compared to, e.g., the transfer method described in Japanese Patent Application Laid-Open No. 63-301960. Further, a wide variety of recording mediums can be selected, as no supporting member is required such as gripping with grippers, adhering, maintaining curvature, etc., as shown in FIG. 1 of Japanese Patent Application Laid-Open No. 63-301960, but rather, the image can be transferred from the intermediate transfer member to the recording medium.

For example, paper of various thickness, from thin paper sheets (40 g/m$^2$) to thicker paper sheets (200 g/m$^2$) can be used for transfer of the image, regardless of the width, or length thereof. Accordingly, transfer can be conducted to envelopes, postcards, labels, and the like.

In light of such advantages, there are already color photocopiers, color printers, and the like on the market using intermediate transfer members.

The form of the intermediate transfer member may be either drum-shaped or belt-shaped, but the belt-shaped intermediate transfer member is more effective, given the freedom in design of the transfer member, and the fact that costs may be lowered by employing such a belt-shaped intermediate transfer member. A belt shaped intermediate transfer member is disclosed in Japanese Patent Application Laid-Open No. 59-77467, which is constructed of a transfer layer of silicone rubber or fluoro-rubber or the like, layered upon a heat-resistant resin film base of polyimide or the like.

However, there have been problems with employing belt-shaped intermediate transfer members, such as the following: i.e., if the intermediate transfer member is formed of elastomer with low tensile modulus of elasticity, the relative position between the intermediate transfer member and the photosensitive drum in one color image transfer cycle changes due to "stretching", thus causing colors to be offset one from another when the toner images are layered one upon another.

On the other hand, when the intermediate transfer member is formed of resin film which has a relatively great tensile modulus of elasticity as compared to elastomer, stretching does not occur, but on the other hand, creeping occurs after prolonged usage of several thousand hours, and there have been problems where the circumferencial length stretches beyond the stipulated length.

Further, the hardness (compression modulus of elasticity) of resin film is relatively greater than that of elastomer, resulting in an undesirable phenomena called"hollowing" wherein, as shown in FIG. 4, the image 100 is not sufficiently transferred except for the outline thereof.

While a core of fabric or cloth may be imbedded in the intermediate transfer member by means of immersion or pressing as a means to prevent stretching or creeping of the intermediate transfer member. Japanese Utility Model Application Laid-Open No. 3-69166 discloses an intermediate transfer belt which is provided with a core material made of a thread or cloth on inner surface of rubber belt. Such attempts have resulted in microscopic irregularities in electric resistance and irregular transfer current, so that a good image could not be obtained in some cases. Moreover, in the case of using a belt-shaped intermediate transfer member, irregularities in the belt thickness and non-uniformity on the spacing between the rollers supporting the belt causing uneven stress placed on the supporting rollers by the belt, resulting in a phenomena where the belt shifts to one side or the other. As a result, problems arose such as the edge portion of the belt cracking or tearing, or the layered component color images being offset from one another.

As for means of preventing the belt-shaped intermediate transfer member from shifting, the belt may be, for example, provided with guide ribbing on the inner side thereof, and caused to run on grooves provided on the supporting rollers. Also, belt edge detection sensors may be provided on both edges of the belt-shaped intermediate transfer member, so that the sensors detect the edge of the belt-shaped intermediate transfer member when shifting occurs, and the position of the supporting rollers are changed so as to correct the shifting.

Further, protrusions may be formed on the outer circumference of the supporting rollers to control shifting of the belt-shaped intermediate transfer member. However, each of these methods of preventing shifting resulted in complication of the apparatus and increased costs.

SUMMARY OF THE INVENTION

It is an object of the present invention to provide an intermediate transfer member with excellent durability which does not exhibit stretching or creeping.

It is another object of the present invention to provide an intermediate transfer member which does not shift even without providing members to prevent shifting.

It is a further object of the present invention to provide an electrophotography apparatus which does not exhibit hollowing of formed images or color offset and obtains clear images.

It is yet a further object of the present invention to provide a method of manufacturing an intermediate transfer member so as to efficiently manufacture the intermediate transfer member of the present invention.

The intermediate transfer member according to the present invention comprises: a base layer; and a surface layer provided upon the aforementioned base layer; wherein the aforementioned base layer is formed of elastomer, and the aforementioned surface layer is formed of engineering plastic.

Also, the electrophotography apparatus according to the present invention comprises: an electrophotographic photosensitive member; charging means for charging the aforementioned electrophotographic photosensitive member; image exposure means for conducting image exposure to the aforementioned charged electrophotographic photosensitive member, thereby forming an electrostatic latent image; developing means for developing the aforementioned electrostatic latent image and forming a toner image upon the aforementioned electrophotographic photosensitive member; and an aforementioned intermediate transfer member to which the aforementioned toner image is transferred.

Moreover, the method of manufacturing the intermediate transfer member according to the present invention comprises: a process of rotating a cylindrical rotor and forming a surface layer of engineering plastic on the inner side of the aforementioned rotor, and a process of forming an elastomer base layer on the inside of the aforementioned surface layer without removing the aforementioned surface layer from the aforementioned rotor.

DESCRIPTION OF THE PREFERRED EMBODIMENT

Figure 1:
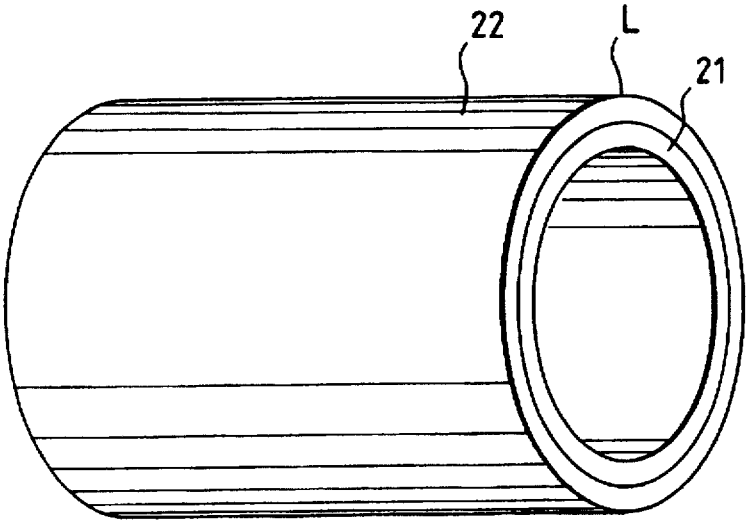
FIG. 1 is a perspective view of one example of the intermediate transfer member according to the present invention.

As shown in FIG. 1, the intermediate transfer member according to the present invention is comprised of at least a base layer 21 and a surface layer 22 provided upon this base layer 21. The base layer 21 is formed of elastomer, and the surface layer 22 is formed of engineering plastic. The intermediate transfer member according to the present invention is either in an endless belt form, or cylindrical form, and it is preferable that there be no seams.

Examples of elastomers which can be used for the base layer 21 include: rubbers such as natural rubber, styrene-butadiene rubber, high styrene rubber, butadiene rubber, isoprene rubber, ethylene-propylene rubber, nitrile rubber, chloroprene rubber, butyl rubber, silicone rubber, fluoro-rubber, urethane rubber, acrylic rubber, epichlorohydrin rubber, norbornene rubber, ethylene-acrylic rubber, chlorosulfonated polyethylene, chlorinated polyethylene, polysulfide rubber, and phosphazene rubber; and thermal plasticity elastomers such as polystyrenes, polyolefines, polyurethanes, polyesters, polyamides, 1,2-polybutadienes, ethylene-vinyl acetates, polyvinyl chlorides, natural rubbers, fluoro-rubbers, trans-polyisoprenes, and chlorinated polyethylenes. Of the aforementioned elastomers, the rubbers should preferably be made to be bridged rubbers by means of methods appropriate for each rubber, such as radiation bridging wherein irradiation is conducted with electron beams or the like, chemical bridging using sulfur, peroxides or amines, or a method where two liquids are mixed, namely the main ingredient and a hardener.

It is preferable that the base layer 21 have a hardness in the range of 40 to 70 degrees, from the perspective of preventing hollowing. A JIS-A type hardness meter was used for measuring the hardness regarding the present invention. The thickness of the base layer 21 should preferably be between 100 μm to 1,500 μm, and more preferably between 500 μm to 1,000 μm.

The definition of the engineering plastics to be used for the surface layer 22 is a polymer compound which has features that deformation hardly causes in high temperature, almost all mechanical properties at normal temperature are maintained. Particularly, the engineering plastics to be used in the present invention have tensile strength of 50 $N/mm^2$ or more, modulus of elasticity in bending of 2,000 $N/mm^2$ or more, and heat deformation temperature of 100° C. or more. Further, it is preferable that the engineering plastics have tensile strength of 5,000 $N/mm^2$ or less, modulus of elasticity in bending of 200,000 $N/mm^2$ or less, and heat deformation temperature of 10,000° C. or less. In the present invention, the values of the tensile strength have been measured in accordance with ASTM D-638. Further, the values of the modulus of elasticity in bending and the values of the heat deformation temperature have been measured in accordance with ASTM D-790 and ASTM D-648, respectively.

The engineering plastic to be used for the surface layer 22 includes the following resins. For example, preferably used are: polyester, polyarylate, polyphenylene ether, polyamidoimide, polyphenylene sulfide, polyimide, the so-called five major engineering plastics (polyacetal, polyamide, polycarbonate, polybutylene telephthalate, polyphenylene oxide) which have excellent dynamic properties, heat resistance, and endurance; super engineering plastics which have even more excellent properties in heat resistance; and polyether imide, polyether sulfone, polysulfone, and polyphenyl sulphone which have the longest dimensional stability. Of all resins, engineering plastics have the highest modulus of elasticity. Accordingly, the intermediate transfer member according to the present invention does not have stretching and is excellent in dimensional stability.

The surface layer 22 may contain synthetic rubbers such as NBR, EPDM, CR, or the like, or urethane or the like, besides engineering plastic. However, the amount of engineering plastic in the surface layer 22 should be 50% by weight or more as compared to the entirety thereof.

The tensile modulus of elasticity of the surface layer 22 should be 2,000 $N/mm^2$ or greater, and further preferably between 2,000 to 10,000 $N/mm^2$. If the tensile modulus of elasticity of the surface layer is too small, the intermediate transfer member is easily deformed. On the other hand, if the tensile modulus of elasticity of the surface layer is too great, it becomes difficult to cause the intermediate transfer member to follow the outer circumference of the supporting rollers, thereby making it easier for breaking or tearing to occur. The values for tensile modulus of elasticity regarding the present invention have been measured in accordance with JIS-7127, at a tensile speed of 10 mm/min.

The thickness of the surface layer 22 should be thin in order to keep the flexibility of the base layer 21, preferably 1 mm or thinner, and more preferably in a range between 10 μm to 300 μm.

The hardness of the intermediate transfer member of the present invention should preferably be between 40 to 100 degrees, and more preferably between 60 to 100 degrees. If the hardness is too small, the intermediate transfer member is easily deformed, thus making it easier for offsetting in the layering of toner images to occur. If the hardness is too great, on the other hand, hollowing occurs easily. The hardness values used regarding the present invention have been made using a JIS-A type hardness meter, and measurements were made from the surface layer side.

As a method for forming the intermediate transfer member according to the present invention, centrifugal formation is preferable because both the base layer and surface layer can be formed in a continuous process using the same manufacturing equipment.

In a method for forming the intermediate transfer member according to the present invention, the base layer and the surface layer thereof can be adhered without employing adhesive agents, thus allowing for the intermediate transfer member to have a uniform thickness.

When the base layer is preferably selected from the groups of polyurethane, chloroprene rubber, isoprene rubber, nitrile rubber, and styrene-butadiene rubber and the surface layer is selected from the groups of polyphenyl sulphone, polysulfone, polyether sulfone, polyester, polyacetal, polyarylate, polyamide, polycarbonate, polyphenylene ether, polyether imide, polyamidoimide, polyphenylene sulfide, and polyimide, the base layer and the surface layer are strongly adhered. Further, it is preferable that the base layer is polyurethane and the surface layer is selected from the groups of polyphenyl sulphone, polysulfone, polyether sulfone, polyester, polyacetal, polyarylate, polyamide, and polycarbonate. Further, it is preferably that the base layer is polyurethane and the surface layer is selected from the groups of polyphenyl sulphone, polyether sulfone, polyester, and polyamide.

Figure 2:
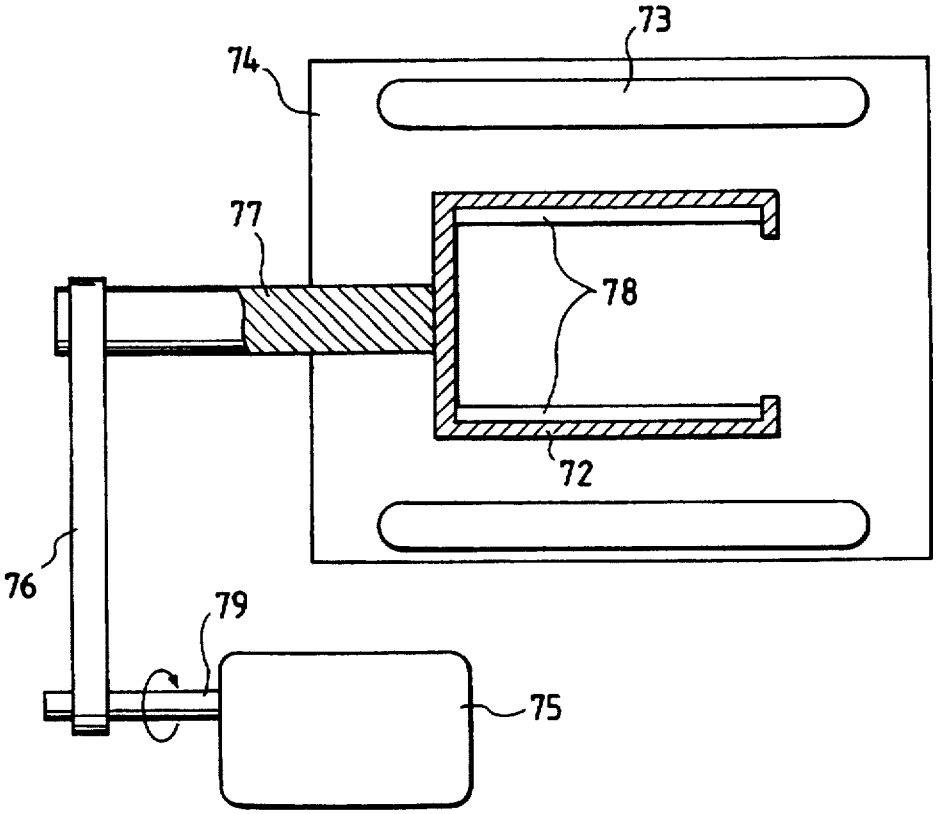
FIG. 2 is a side view of one example of a centrifugal forming machine used in the manufacturing of the intermediate transfer member according to the present invention.

The apparatus shown in FIG. 2 is the centrifugal forming machine used for executing centrifugal forming, with a cylindrical rotor 72 being provided within a heating furnace 74. A shaft 77 is connected to the center of rotation of the cylindrical rotor 72. The shaft 77 is linked to the rotating shaft 79 of a driving motor 75 via a drive belt 76. Heating fins 73 employing steam are arranged around the rotor 72, thereby heating the rotor 72.

First, the ingredients 78 for the item to be formed are placed inside the cylindrical rotor 72 in liquid form. Next, the driving motor 75 is driven so as to rotate the cylindrical rotor 72, and at the same time, the ingredients 78 are heated by means of the heating fins 73. Consequently, an endless belt-shaped formation is formed on the inner side of the rotor 72.

When the intermediate transfer member according to the present invention is formed by employing the centrifugal forming method, the ingredients for the surface layer are first placed inside the cylindrical rotor 72 and the surface layer is thus formed. Subsequently, ingredients for the base layer are then placed inside the cylindrical rotor 72 without removing the earlier-formed surface layer, and the base layer is thus formed inside the surface layer. After forming the base layer, the formed item is cooled to room temperature and removed from the centrifugal forming machine, thus obtaining the intermediate transfer member according to the present invention.

It is preferable that the cylindrical rotor 72 rotates at a rate of 200 RPM to 2,000 RPM. The temperature of the heating fins 73 should preferably be in a range between 70° C. to 200° C., although the temperature differs according to the ingredients being used to form the item.

Further, since the surface roughness of the intermediate transfer member is determined by the condition of the inner surface of the cylindrical rotor 72, the intermediate transfer member does not need to be polished if the inner surface of the cylindrical rotor 72 is finished to a high precision.

The intermediate transfer member according to the present invention should preferably have volume resistivity in the direction of thickness of $10^5$ to $10^{12}$ Ω·cm, and more preferably, $10^8$ to $10^{10}$ Ω·cm. If the volume resistivity of the intermediate transfer member is too small, excessive transfer current flows through. On the other hand, if the volume resistivity of the intermediate transfer member is too great, sufficient current cannot be obtained, and consequently toner transfer cannot be conducted well. The values for volume resistivity regarding the present invention have been measured in accordance with JIS-6911, under application of voltage of 500 V.

Conductive filler may be included in the surface layer, the base layer, or both the surface layer and the base layer, in order to adjust the volume resistivity of the intermediate transfer member according to the present invention. Any generally used conductive fillers may be used as the conductive filler here, but carbon fillers such as Furnace Black, Acetylene Black, KETJEN Black, graphite, and carbon fiber, and metal oxide fillers wherein metal oxides such as tin oxide, zinc oxide or titanium oxide have been subjected to doping of impurity ions, are particularly preferably employed. The amount of inclusion of conductive filler is preferably in the range of 1 to 35% by weight for each layer.

Further, lubricants L (see FIG. 1) may be included in the surface layer in order to increase the efficiency of image transfer of the toner image by the intermediate transfer member, or to maintain the surface properties of the intermediate transfer member, particularly roughness, over a prolonged period. Preferably employed as lubricants are fluoro-resin powders such as ETFE (ethylene-tetrafluoro ethylene copolymer) or PTFE (polytetrafluoro ethylene), molybdenum bisulfide, graphite, graphite fluoride, boron nitride, and silicone resin particles. The inclusion amount of the lubricant in the surface layer is preferably in a range of 25 to 50% by weight thereof. Or, a lubricating layer containing the lubricant therein may be provided upon the surface layer. Even when providing a lubricating layer, the inclusion amount of the lubricant therein should preferably be in a range of 25 to 50% by weight.

Now, the electrophotography apparatus according to the present invention will be described with reference to FIG. 3. Reference numeral 1 denotes a rotary drum-shaped electrophotographic photosensitive member (herein below referred to as"a photosensitive drum"), and which is driven rotatably in an anticlockwise direction as shown by the arrow at a prescribed circumferencial speed (process speed).

The surface of the photosensitive drum 1 is uniformly charged during rotation by means of a primary charger (corona charger) 2 to impart an electric charge having a prescribed polarity and potential. The photosensitive drum 1 is then subjected to an image exposure means which is not shown in the FIG., whereby image exposure 3 is received so that an electrostatic latent image corresponding to the image component of a first color (e.g. a magenta image) of the desired color image is formed.

Thereafter the electrostatic latent image is developed using a magenta toner M which is the first color by the first developer 41 (magenta (M) developer). During this operation, the second, to fourth developers, 42, 43, and 44 (respectively cyan (C), yellow (Y), and black (BK) ) are inoperative and do not effect the photosensitive drum 1, so that: the first magenta toner image is not disturbed by the second to fourth development means 42 to 44.

The image component of the first color (i.e. the aforementioned magenta toner image) supported on the photosensitive drum 1 is transferred to the peripheral surface of the intermediate transfer member 20 while passing through the nip portion between the photosensitive drum 1 and the intermediate transfer member 20 by means of a primary transfer bias voltage which is applied to the intermediate transfer member 20. The primary transfer bias voltage is applied by means of the bias power source 30. The intermediate transfer member 20 is supported by means of the supporting rollers 60, 61, 62, and 63, and is rotated in a clockwise direction shown by the arrow at the same circumferencial speed as the photosensitive drum 1.

The peripheral surface of the photosensitive drum 1 is cleaned by means of a cleaning means 14 after the magenta toner image has been transferred.

Subsequently, a cyan toner image which is the second color, a yellow toner image which is the third color, and a black toner image which is the fourth color, are then transferred in succession onto the intermediate transfer member 20 in the same manner, so that a synthesized color toner image corresponding to the desired color image is formed.

Reference numeral 25 denotes a transfer roller, which is arranged so as to be able to come into contact with the intermediate transfer member 20 or to depart therefrom. The toner image upon the intermediate transfer member 20 is then transferred onto the recording medium 24 pinched between the intermediate transfer member 20 and the transfer roller 25. Secondary transfer bias voltage has been applied to the transfer roller 25 by means of a bias power source 29, and the toner image is transferred to the recording medium 24 by means of this secondary transfer bias voltage.

The transfer medium 24, such as paper or the like, is supplied from a paper supply cassette 9 in a manner synchronous with the rotation of the intermediate transfer member 20. The transfer roller 25 is not in contact with the intermediate transfer member 20 while the toner image is transferred from the photosensitive drum 1 to the intermediate transfer member 20.

The transfer medium 24 whereupon a toner image has been transferred is transported to a fixing unit 51 where it is subjected to fixing by means of application of heat. Subsequently, the residual toner upon the intermediate transfer member 20 is cleaned by means of a cleaner 35 which comes into contact with the intermediate transfer member 20.

It is preferable that the primary transfer bias voltage be of inverse polarity as compared with that of the toner, and be within the range of +2 kV to +5 kV. The secondary transfer bias voltage preferably is 1 kV to +3 kV.

Although the description of the apparatus given above has been made with reference to the example of a color electrophotography apparatus, it is needless to say that the intermediate transfer member according to the present invention can be employed in a monocolor electrophotography apparatus, as well.

The friction coefficient of the inner surface of the intermediate transfer member according to the present invention, i.e., the surface facing the supporting rollers 60 to 63, should preferably be 0.7 or less, and more preferably in the range of 0.1 to 0.7. In the case where the friction coefficient of the inner surface of the intermediate transfer member is great, and there is no shifting prevention member provided to the electrophotography apparatus, shifting occurs as a result of the spacing between the rollers 60 to 63 supporting the intermediate transfer member not being uniform. Such shifting can be prevented even without providing a shifting prevention member, by means of setting the friction coefficient of the inner surface of the intermediate transfer member so as to be 0.7 or less. Or, providing a simple guide member can prevent occurrence of shifting without damaging the intermediate transfer member.

In order to make the friction coefficient of the inner surface of the intermediate transfer member so as to be 0.7 or less, a lubricating layer, formed of, e.g., elastomer containing a lubricant, may be provided on the inner side of the intermediate transfer member.

Examples of lubricants preferably included in the lubricating layer include metal soaps such as stearate, fatty acid amide, fluoro-resin powders such as ETFE or PTFE, molybdenum bisulfide, graphite, graphite fluoride, boron nitride, silicon nitride, silicone resin particles, silicone oil, silicone rubber particles, and the like. The average particle diameter of the lubricant is preferably in the range of 0.1 μm to 3 μm.

While the elastomer to be used in the lubricating layer may be any of the elastomers used in the aforementioned base layer, in order to avoid the necessity of employing adhesive agents, the lubricating layer and the base layer should be of an elastomer of the same type, or at least of elastomers which have good compatibility.

The amount of inclusion of the lubricant preferably is 15 to 50% by weight as to the entirety of the lubricating layer. The lubricating layer should preferably be 5 μm to 30 μm in thickness. The lubricating layer may be formed by means of centrifugal formation following formation of the base layer.

The lubricant may be contained in the base layer, without provided a lubricating layer as such. In this case, the amount of inclusion of the lubricant preferably is 15 to 50% by weight as to the entirety of the base layer.

Further, the friction coefficient of the inner side of the intermediate transfer member may be reduced even without using lubricants at all, by means of employing low-friction elastomers such as silicone-grafted urethane or the like as the material for the base layer. The values of the friction coefficient of the inner side of the intermediate transfer member have been measured in accordance with JIS-7125.

EXAMPLE 1

(Formation of the surface layer)

100 parts by weight of polyphenyl sulfone was used as a binder, this being dissolved in dimethyl acetamide (DMAC) so that the binder concentration was 20% by weight, to which was added 7 parts by weight of conductive carbon (KETJEN Black 600JD, manufactured by KETJEN Black International Co., Ltd.) and dispersed for 30 minutes by means of a paint shaker. This dispersed liquid was placed in the centrifugal forming machine shown in FIG. 2, and dry forming was conducted for 30 minutes at a rotor rotation rate of 1,500 RPM and a temperature within the rotor of 120° C. The inner diameter of the rotor 2 was 140 mm, the length thereof 350 mm, finished with hard chrome electroplating.

(Formation of the base layer)

The base layer was formed of polyurethane. 100 parts by weight of polyole was heated to 80° C., to which was added 10 parts by weight of conductive carbon (KETJENT Black 600JD) and dispersed for 1 hour by means of a stirrer, subsequently to which was added 60 parts by weight of isocyanate heated to 80° C., and dispersed for 3 minutes by means of a stirrer. This dispersed liquid was placed in the centrifugal forming machine following the formation of the surface layer, and thermal hardening was conducted for 3 hours at a rotor rotation rate of 2,000 RPM and a temperature within the rotor of 120° C.

Next, aging was conducted for 15 hours at a temperature of 80° C., following which the formed material was allowed to cool to room temperature. The formed item was then removed from the forming machine and the edges thereof were cut off, thus obtaining the intermediate transfer member according to the present invention.

The obtained intermediate transfer member exhibited a surface layer of 150 μm in thickness, a base layer of 800 μm in thickness, a length of 250 mm, hardness of 91, and a volume resistance value of $10^8$ Ω·cm.

Figure 3:
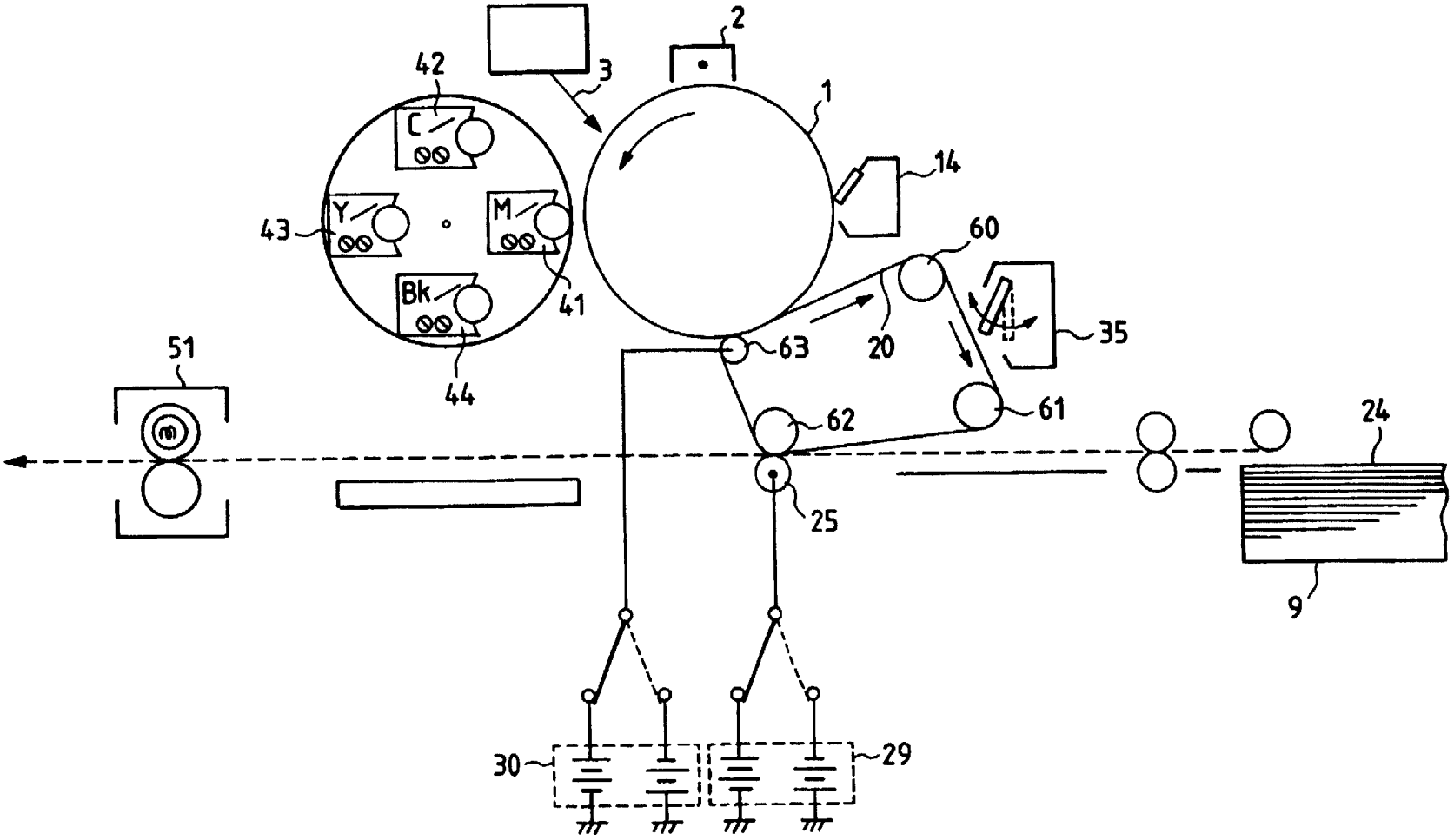
FIG. 3 is a side view of one example of the electrophotography apparatus according to the present invention.
Figure 4:
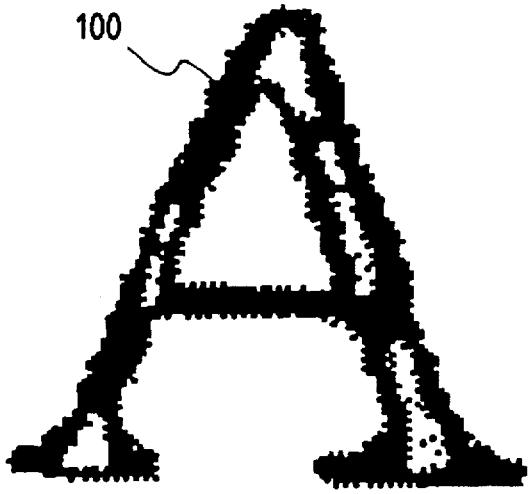
FIG. 4 is an example of hollowing occurring as the result of a conventional intermediate transfer member.

The intermediate transfer member thus obtained was mounted in an electrophotography apparatus as shown in FIG. 3, tension of 50N was applied to the intermediate transfer member, and durability testing of image output was conducted. With the electrophotography apparatus using this embodiment, protrusions are formed on the outer circumference of the supporting rollers supporting the intermediate transfer member, in order to prevent shifting of the intermediate transfer member. For the test, image forming of a color test pattern was conducted on 300 sheets of recording paper in consecutive succession, following which continuous operation was conducted for 200 hours without recording but only rotating, with the tension at a constant. Subsequently, recording was conducted on 300 sheets again, and this cycle was repeated. Image evaluation and measurement of extention of the intermediate transfer member was conducted from the time the testing was begun up to 2,000 hours after. Evaluation of the formed image was conducted on the image formed on the 300th sheet for each cycle, and the image was inspected by means of a microscope for offset of layered toner images and hollowing. The inspection revealed that there was no hollowing for any of the images. Also, the outer circumferencial length of the intermediate transfer member was measured after the endurance testing, and the extension percentage thereof was calculated by the following expression:

Extension percentage (%)={(outter circumferencial length after test−outer circumferencial length before test)÷Outer circumferencial length before test}×100

The results of the evaluation are shown in Table 1. The data regarding layering offset in the Table is that from the last image.

EXAMPLE 2

An intermediate transfer member was prepared with the same ingredients as with Example 1, except that polyether sulfone was used for the binder for the surface layer.

The obtained intermediate transfer member exhibited a surface layer of 100 μm in thickness, a base layer of 700 μm in thickness, a length of 250 mm, hardness of 90, and a volume resistance value of $10^7$ Ω·cm.

Evaluation of this intermediate transfer member was conducted in the same manner as with Example 1. The results thereof are shown in Table 1.

EXAMPLE 3

An intermediate transfer member was prepared with the same ingredients as with Example 1, except that polysulfone was used for the binder for the surface layer, and that dimethyl formamaide (DMF) was used for the solvent.

The obtained intermediate transfer member exhibited a surface layer of 80 μm in thickness, a base layer of 900 μm in thickness, a length of 250 mm, hardness of 91, and a volume resistance value of $10^9$ Ω·cm.

Evaluation of this intermediate transfer member was conducted in the same manner as with Example 1. The results thereof are shown in Table 1.

EXAMPLE 4

An intermediate transfer member was prepared with the same ingredients as with Example 1, except that polyether imide was used for the binder for the surface layer, and that methylene chloride was used for the solvent.

The obtained intermediate transfer member exhibited a surface layer of 50 μm in thickness, a base layer of 600 μm in thickness, a length of 250 mm, hardness of 88, and a volume resistance value of $10^8$ Ω·cm.

Evaluation of this intermediate transfer member was conducted in the same manner as with Example 1. The results thereof are shown in Table 1.

TABLE 1

| Example | Surface Layer | Base Layer | Layering Offset (μm) | Stretching (%) | Hollowing |
|---|---|---|---|---|---|
| 1 | Polyphenyl sulfone | Urethane | 60 | 0.4 | None |
| 2 | Polyether sulfone | Urethane | 50 | 0.4 | None |
| 3 | Polysulfone | Urethane | 80 | 0.4 | None |
| 4 | Polyether imide | Urethane | 75 | 0.5 | None |

EXAMPLE 5

(Formation of the surface layer)

100 parts by weight of polyphenyl sulfone was used as a binder, this being dissolved in a solvent, i.e., DMAC., so that the binder concentration was 20% by weight, to which was added 8 parts by weight of conductive carbon (KETJEN Black 600JD) and dispersed for 30 minutes by means of a paint shaker. This dispersed liquid was placed in a centrifugal forming machine the same as with Example 1, and dry forming was conducted for 30 minutes at a rotor rotation rate of 1,500 RPM and a temperature within the rotor of 120° C.

(Formation of the base layer)

Liquid silicone was used as a binder. 100 parts by weight of liquid silicone, 50 parts by weight of hardener, and 8 parts by weight of conductive carbon (KETJEN Black 600JD) were mixed and dispersed by means of a stirrer, and heated to 60° C. to lower viscosity. This dispersed liquid was placed in the centrifugal forming machine following the formation of the surface layer, and thermal hardening was conducted for 1 hour at a rotor rotation rate of 2,000 RPM and a temperature within the rotor of 150° C.

Next, the formed material was allowed to cool to room temperature. The formed item was then removed from the forming machine and the edges thereof were cut off, thus obtaining the intermediate transfer member according to the present invention.

The obtained intermediate transfer member exhibited a surface layer of 250 μm in thickness, a base layer of 700 μm in thickness, a length of 250 mm, hardness of 90, and a volume resistance value of $10^5$ Ω·cm.

Evaluation of this intermediate transfer member was conducted in the same manner as with Example 1. The results thereof are shown in Table 2.

EXAMPLE 6

(Formation of the surface layer)

A surface layer was formed with the same ingredients as with Example 5.

(Formation of the base layer)

10 parts by weight of conductive carbon (KETJEN Black 600JD) were dispersed in 100 parts by weight of EPDM which was dissolved in a solvent for 20 minutes by means of a paint shaker. This dispersed liquid was placed in the centrifugal forming machine following the formation of the surface layer, and thermal drying was conducted for 1 hour at a rotor rotation rate of 2,000 RPM and a temperature within the rotor of 90° C.

Next, the formed material was allowed to cool to room temperature. The formed item was then removed from the forming machine and the edges thereof were cut off, thus obtaining the intermediate transfer member according to the present invention.

The obtained intermediate transfer member exhibited a surface layer of 250 μm in thickness, a base layer of 1,000 μm in thickness, a length of 250 mm, hardness of 95, and a volume resistance value of $10^6$ Ω·cm.

Evaluation of this intermediate transfer member was conducted in the same manner as with Example 1. The results thereof are shown in Table 2.

TABLE 2

| Example | Surface Layer | Base Layer | Layering Offset (μm) | Stretching (%) | Hollowing |
|---|---|---|---|---|---|
| 5 | Polyphenyl sulfone | Silicone | 70 | 0.5 | None |
| 6 | Polyphenyl sulfone | EPDM | 50 | 0.4 | None |

EXAMPLE 7

<Resistance adjustment by tin oxide>

(Formation of the surface layer)

100 parts by weight of polyphenyl sulfone was used as a binder, this being dissolved in a solvent, i.e., DMAC, so that the binder concentration was 20% by weight, to which was added 18 parts by weight of tin oxide (Sb doped material) and dispersed for 30 minutes by means of a paint shaker. This dispersed liquid was placed in a centrifugal forming machine shown in FIG. 2, and dry forming was conducted for 30 minutes at a rotor rotation rate of 1,500 RPM and a temperature within the rotor of 120° C.

(Formation of the base layer)

A base layer was formed with the same ingredients as with Example 1.

The obtained intermediate transfer member exhibited a surface layer of 50 μm in thickness, a base layer of 500 μm in thickness, a length of 250 mm, hardness of 85, and a volume resistance value of $10^{10}$ Ω·cm.

Evaluation of this intermediate transfer member was conducted in the same manner as with Example 1. The results thereof are shown in Table 3.

EXAMPLE 8

<Resistance adjustment by carbon fiber>

An intermediate transfer member was prepared in the same manner as with Example 7, except that 4 parts by weight of carbon fiber was used instead of the tin oxide as conductive material. The carbon fibers used were of an average fiber diameter of 5 μm and an average fiber length of 20 μm.

The obtained intermediate transfer member exhibited a surface layer of 90 μm in thickness, a base layer of 700 μm in thickness, a length of 250 mm, hardness of 88, and a volume resistance value of $10^8$ Ω·cm.

Evaluation of this intermediate transfer member was conducted in the same manner as with Example 1. The results thereof are shown in Table 3.

TABLE 3

| Example | Surface Layer | Base Layer | Conductive Material | Layering Offset (μm) | Stretching (%) | Hollowing |
|---|---|---|---|---|---|---|
| 7 | Polyphenyl sulfone | Urethane | Tin oxide | 70 | 0.2 | None |

TABLE 3-continued

| Example | Surface Layer | Base Layer | Conductive Material | Layering Offset (μm) | Stretching (%) | Hollowing |
|---|---|---|---|---|---|---|
| 8 | Polyphenyl sulfone | Urethane | Carbon fiber | 80 | 0.4 | None |

EXAMPLE 9

<Alteration of surface properties by PTFE>

(Formation of the surface layer)

100 parts by weight of polyphenyl sulfone was used as a binder, this being dissolved in a solvent, i.e., DMAC., so that the binder concentration was 20% by weight, to which were added 8 parts by weight of conductive carbon (KETJEN Black 600JD) and 30 parts by weight of PTFE particles having an average particle diameter of 0.3 μm, the PTFE particles being added as an improving agent for improving the toner releasability (transferability), and dispersed for 30 minutes by means of a paint shaker. This dispersed liquid was placed in the centrifugal forming machine shown in FIG. 2, and dry forming was conducted for 30 minutes at a rotor rotation rate of 1,500 RPM and a temperature within the rotor of 120° C.

(Formation of the base layer)

A base layer was formed with the same ingredients as with Example 1.

The obtained intermediate transfer member exhibited a surface layer of 150 μm in thickness, a base layer of 650 μm in thickness, a length of 250 mm, hardness of 89, and a volume resistance value of $10^5$ Ω·cm.

Evaluation of this intermediate transfer member was conducted in the same manner as with Example 1. Further, evaluation was also made regarding transferring efficiency. In the present invention, "transfer efficiency" refers to the percentage of toner which is transferred from the photosensitive member to the recording paper when toner on the photosensitive member is transferred to the recording paper via the intermediate transfer member. This percentage was measured in the present invention by means of measuring the colorimetry density or concentration of the toner image. That is, the transfer efficiency can be expressed by the following expression:

Transfer efficiency (%)=Colorimetry concentration of toner image on recording paper÷Colorimetry concentration of toner image on photosensitive member×100

The results thereof are shown in Table 4. Further, the transfer efficiency of the intermediate transfer member of Example 1 was also measured, and is shown in Table 4, as well.

EXAMPLE 10

<Alteration of surface properties by molybdenum bisulfide>

An intermediate transfer member was prepared with the same ingredients as with Example 9, except that 4 parts by weight of molybdneum bisulfide was used instead of the PTFE particles. The molybdneum bisulfide used was that of average particle diameter of 0.5 μm.

The obtained intermediate transfer member exhibited a surface layer of 100 μm in thickness, a base layer of 900 μm in thickness, a length of 250 mm, hardness of 93, and a volume resistance value of $10^8$ Ω·cm.

Evaluation of this intermediate transfer member was conducted in the same manner as with Example 9. The results thereof are shown in Table 4.

TABLE 4

| Example | Surface Layer | Base Layer | Improving agent | Layering Offset (μm) | Stretching (%) | Hollowing | Transfer Efficiency (%) |
|---|---|---|---|---|---|---|---|
| 1 | Polyphenyl sulfone | Urethane | None | 60 | 0.4 | None | 90 |
| 9 | Polyphenyl sulfone | Urethane | PTFE | 70 | 0.5 | None | 95 |
| 10 | Polyphenyl sulfone | Urethane | Molybdenum bisulfide | 75 | 0.5 | None | 94 |

EXAMPLE 11

(Formation of the surface layer)

100 parts by weight of polyphenyl sulfone was used as a binder, this being dissolved in a solvent, i.e., DMAC., so that the binder concentration was 5% by weight, to which was added 8 parts by weight of conductive carbon (KETJEN Black 600JD) and dispersed for 30 minutes by means of a paint shaker. This dispersed liquid was placed in the centrifugal forming machine shown in FIG. 2, and forming was conducted for 30 minutes at a rotor rotation rate of 1,500 RPM and a temperature within the rotor of 120° C.

(Formation of the base layer)

A base layer was formed with the same ingredients as with Example 1.

The obtained intermediate transfer member exhibited a surface layer of 10 μm in thickness, a base layer of 900 μm in thickness, a length of 250 mm, hardness of 92, and a volume resistance value of $10^8$ Ω·cm.

Evaluation of this intermediate transfer member was conducted in the same manner as with Example 1. The results thereof are shown in Table 5.

TABLE 5

| Example | Surface Layer | Base Layer | Conductive Material | Layering Offset (μm) | Stretching (%) | Hollowing |
|---|---|---|---|---|---|---|
| 11 | Polyphenyl sulfone | Urethane | Conductive carbon | 80 | 0.5 | None |

COMPARATIVE EXAMPLE 1

100 parts by weight of polyphenyl sulfone was used as a binder, this being dissolved in a solvent, i.e., DMAC., so that the binder concentration was 20% by weight, to which was added 8 parts by weight of conductive carbon (KETJEN Black 600JD) and dispersed for 30 minutes by means of a paint shaker. This dispersed liquid was placed in a centrifugal forming machine shown in FIG. 2, and dry forming was conducted for 30 minutes at a rotor rotation rate of 1,500 RPM and a temperature within the rotor of 120° C., thus obtaining an intermediate transfer member.

The obtained intermediate transfer member was 150 μm in thickness, had a length of 250 mm, and a volume resistance value of $10^8$ Ω·cm.

Evaluation of this intermediate transfer member was conducted in the same manner as with Example 1. The results thereof are shown in Table 6.

When this intermediate transfer member was used for image forming, hollowing of the image occurred due to increased pressure during transferring.

TABLE 6

| Comparative Example | Binder | Layering Offset (μm) | Stretching (%) | Hollowing |
|---|---|---|---|---|
| 1 | Polyphenyl sulfone | 60 | 0.5 | Occurred |

COMPARATIVE EXAMPLE 2

(Formation of the base layer)

The base layer was formed of polyurethane. 100 parts by weight of polyole was heated to 80° C., to which was added 10 parts by weight of conductive carbon (KETJEN Black 600JD) and dispersed for 1 hour by means of a stirrer, subsequently to which was added 60 parts by weight of isocyanate heated to 80° C., and dispersed for 3 minutes by means of a stirrer. This dispersed liquid was placed in a centrifugal forming machine, and thermal hardening was conducted for 3 hours at a rotor rotation rate of 2,000 RPM and a temperature of 120° C. Next, aging was conducted for 15 hours at a temperature of 80° C., following which the formed material was allowed to cool to room temperature. The formed item was then removed from the forming machine and the edges thereof were cut off.

(Formation of the surface layer)

9 parts by weight of conductive carbon (KETJEN Black 600JD) was added to 100 parts by weight of polyethylene, dispersion thereof was conducted by means of heat rolling, following which a surface layer was formed by means of an cross-head extruder. This surface layer and the base layer were adhered by means of the application of heat and pressure at a temperature of 150° C., thereby obtaining an intermediate transfer member.

The obtained intermediate transfer member exhibited a surface layer of 130 μm in thickness, a base layer of 700 μm in thickness, a length of 250 mm, and a volume resistance value of $10^9$ Ω·cm.

Evaluation of this intermediate transfer member was conducted in the same manner as with Example 1. The results thereof are shown in Table 7.

TABLE 7

| Comparative Example | Surface Layer Binder | Base layer | Layering Offset (μm) | Stretching (%) | Hollowing |
|---|---|---|---|---|---|
| 2 | Polyethylene | Urethane | 250 | 3.5 | None |

COMPARATIVE EXAMPLE 3

100 parts by weight of polyole was heated to 80° C., to which was added 10 parts by weight of conductive carbon (KETJEN Black 600JD) and dispersed for 1 hour by means of a stirrer, subsequently to which was added 60 parts by weight of isocyanate heated to 80° C., and dispersed for 3 minutes by means of a stirrer. This dispersed liquid was placed in a centrifugal forming machine, and thermal hardening was conducted for 3 hours at a rotor rotation rate of 2,000 RPM and a temperature of 120° C. Next, aging was conducted for 15 hours at a temperature of 80° C., following which the formed material was allowed to cool to room temperature. The formed item was then removed from the forming machine and the edges thereof were cut off, following which the formed item was sprayed with a fluorine elastomer latex, and dried, thereby obtaining an intermediate transfer member.

The obtained intermediate transfer member exhibited a thickness of 750 μm in thickness, had a length of 250 mm, and a volume resistance value of $10^8$ Ω·cm.

When evaluation the same as with Example 1 was conducted regarding this intermediate transfer member, the permanent elongation at the end of the evaluation testing was 0.5% or less, and there was no hollowing, but there was positional offset of toner during image formation owing to elastic stretching of the belt, resulting in poor color reproduction.

EXAMPLE 12

A 3-layered belt was prepared according to the following method and evaluated, the belt comprising a surface layer with polyphenyl sulfone as the binder, a base layer of double-liquid polyurethane, and a lubricating layer formed of a compound of PTFE and single-liquid polyurethane.

(Formation of the surface layer)

100 parts by weight of polyphenyl sulfone was used as a binder, this being dissolved in a solvent, N-methyl-2-pyrrolidone (NMP), so that the binder concentration was 20% by weight, to which was added 10 parts by weight of conductive carbon (KETJEN Black 600JD) and dispersed for 30 minutes by means of a paint shaker. This dispersed liquid was placed in a centrifugal forming machine shown in FIG. 2, and hardening was conducted by means of drying for 30 minutes at a rotor rotation rate of 500 RPM and a temperature within the rotor of 120° C.

(Formation of the base layer)

10 parts by weight of conductive carbon (KETJEN Black 600JD) was added to 100 parts by weight of polyole and dispersed for 1 hour by means of a paint shaker, subsequently to which was added 60 parts by weight of isocyanate, and dispersed for 3 minutes by means of a paint shaker. This dispersed liquid was placed in the centrifugal forming machine following the formation of the surface layer, and hardening was conducted by means of drying for 1 hour at a rotor rotation rate of 1,000 RPM and a temperature within the rotor of 120° C. thereby laminating a base layer.

(Formation of the lubricating layer)

The lubricating layer was formed of a compound of PTFE with an average particle diameter of 0.5 μm and single-liquid MDI polyurethane. Specifically, 100 parts by weight of PTFE was dispersed in a toluene/NMP mixture solvent, so as to be 7% by weight, to which 30 parts by weight of polyurethane was added, and dispersed by means of a paint shaker. This dispersed liquid was placed in the centrifugal forming machine following formation of the base layer, and the lubricating layer was laminated by means of drying and hardening for 30 minutes at a rotor rotation rate of 1,000 RPM and a temperature within the rotor of 120° C. Next, aging was conducted for 2 hours at a temperature of 80° C., following which the formed material was allowed to cool to room temperature. The formed item was then removed from the forming machine and the edges thereof were cut off, thereby obtaining an intermediate transfer member according to the present invention.

The obtained intermediate transfer member exhibited a surface layer of 150 μm in thickness, a base layer of 800 μm in thickness, a lubricating layer of 4 μm in thickness, a length of 250 mm, friction coefficient on the inner side of 0.31, hardness of 91, and a volume resistance value in the direction of thickness of $10^{10}$ Ω·cm.

The intermediate transfer member thus obtained was mounted in an electrophotography apparatus as shown in FIG. 3, tension of 50N was applied to the intermediate transfer member, and durability testing of image output was conducted the same as with Example 1. During the testing, the state of shifting of the intermediate transfer member and the condition of the edges were observed every 100 hours. With the electrophotography apparatus using this example, means for preventing shifting of the intermediate transfer member were not provided. According to the above tests, there was no occurrence of shifting of the belt or tearing of the edge portions thereof, and stable operation as conducted for 2,000 hours from when testing was started could be maintained. The results of the evaluation are shown in Table 8.

EXAMPLE 13

An intermediate transfer member was prepared in the same manner as with Example 12, except that molybdenum bisulfide with average particle diameter of 0.5 μm as lubricating particules, and isoprene rubber as an elastomer were used in the lubricating layer.

(Formation of the lubricating layer)

100 parts by weight of molybdneum bisulfide was dispersed in a n-heptane/toluene mixture solvent, so as to be 7% by weight, to which 30 parts by weight of isoprene rubber was added, and dispersed by means of a paint shaker. This dispersed liquid was placed in the centrifugal forming machine following formation of the base layer, and the lubricating layer was laminated by means of drying and hardening for 30 minutes at a rotor rotation rate of 1,000 RPM and a temperature within the rotor of 120° C. Next, aging was conducted for 2 hours at a temperature of 80° C., following which the formed material was allowed to cool to room temperature. The formed item was then removed from the forming machine and the edges thereof were cut off, thereby obtaining an intermediate transfer member according to the present invention.

The obtained intermediate transfer member exhibited a surface layer of 150 μm in thickness, a base layer of 800 μm in thickness, a lubricating layer of 4 μm in thickness, a length of 250 mm, friction coefficient on the inner side of the belt of 0.35, hardness of 90, and a volume resistance value in the direction of thickness of $10^{10}$ Ω·cm.

Evaluation of this intermediate transfer member was conducted in the same manner as with Example 12. The results thereof are shown in Table 8.

EXAMPLE 14

An intermediate transfer member was prepared in the same manner as with an Example 12, except that graphite with an average particle diameter of 0.5 μm as lubricating particles, and silicone rubber as an elastomer were used in the lubricating layer.

(Formation of the lubricating layer)

100 parts by weight of graphite was dispersed in an Ω·heptane/xylene mixture solvent, so as to be 7% by weight, to which 30 parts by weight of isoprene rubber was added, and dispersed by means of a paint shaker. This dispersed liquid was placed in the centrifugal forming machine following formation of the base layer, and the lubricating layer was laminated by means of drying and hardening for 30 minutes at a rotor rotation rate of 1,000 RPM and a temperature within the rotor of 120° C. Next, aging was conducted for 2 hours at a temperature of 80° C., following which the formed material was allowed to cool to room temperature. The formed item was then removed from the forming machine and the edges thereof were cut off, thereby obtaining an intermediate transfer member.

The obtained intermediate transfer member exhibited a surface layer of 150 μm in thickness, a base layer of 800 μm in thickness, a lubricating layer of 4 μm in thickness, a length of 250 mm, friction coefficient on the inner side of the belt of 0.42, hardness of 88, and a volume resistance value in the direction of thickness of $10^{10}$ Ω·cm.

Evaluation of this intermediate transfer member was conducted in the same manner as with Example 12. The results thereof are shown in Table 8.

EXAMPLE 15

An intermediate transfer member was prepared in the same manner as with Example 12, except that silicone resin with average particle diameter of 0.5 μm as lubricating particles, and acrylic rubber as an elastomer were used in the lubricating layer.

(Formation of the lubricating layer)

100 parts by weight of silicone resin was dispersed in an xylene solvent, so as to be 7% by weight, to which 30 parts by weight of acrylic rubber was added, and dispersed by means of a paint shaker. This dispersed liquid was placed in the centrifugal forming machine following formation of the base layer, and the lubricating layer was formed by means of drying and hardening for 30 minutes at a rotor rotation rate of 1,000 RPM and a temperature within the rotor of 120° C. Next, aging was conducted for 2 hours at a temperature of 80° C., following which the formed material was allowed to cool to room temperature. The formed item was then removed from the forming machine and the edges thereof were cut off, thereby obtaining an intermediate transfer member.

The obtained intermediate transfer member exhibited a surface layer of 150 μm in thickness, a base layer of 800 μm in thickness, a lubricating layer of 4 μm in thickness, a length of 250 mm, friction coefficient on the inner side of the belt of 0.33, hardness of 90, and a volume resistance value in the direction of thickness of $10^{10}$ Ω·cm.

Evaluation of this intermediate transfer member was conducted in the same manner as with Example 12. The results thereof are shown in Table 8.

EXAMPLE 16

An intermediate transfer member was prepared in the same manner as with Example 12, except that silicon nitride with average particle diameter of 0.5 μm as lubricating particles, and polystyrene as an elastomer were used in the lubricating layer.

(Formation of the lubricating layer)

100 parts by weight of silicon nitride was dispersed in a xylene solvent, so as to be 7% by weight, to which 30 parts by weight of polystyrene was added, and dispersed by means of a paint shaker. This dispersed liquid was placed in the centrifugal forming machine following formation of the base layer, and the lubricating layer was laminated by means of drying and hardening for 30 minutes at a rotor rotation rate of 1,000 RPM and a temperature within the rotor of 120° C. Next, aging was conducted for 2 hours at a temperature of 80° C., following which the formed material was allowed to cool to room temperature. The formed item was then removed from the forming machine and the edges thereof were cut off, thereby obtaining an intermediate transfer member.

The obtained intermediate transfer member exhibited a surface layer of 150 μm in thickness, a base layer of 800 μm in thickness, a lubricating layer of 5 μm in thickness, a length of 250 mm, friction coefficient on the inner side of the belt of 0.68, hardness of 91, and a volume resistance value in the direction of thickness of $10^{10}$ Ω·cm.

Evaluation of this intermediate transfer member was conducted in the same manner as with Example 12. The results thereof are shown in Table 8.

EXAMPLE 17

An intermediate transfer member was prepared in the same manner as with Example 12, except that no lubricating layer was provided, and that a compound of double-liquid polyurethane and PTFE with average particle diameter of 0.5 μm were used for the base layer.

(Formation of the base layer)

100 parts by weight of PTFE was dispersed in a toluene/NMP solvent, so as to be 7% by weight, to which 100 parts by weight of polyole and 15 parts by weight of conductive carbon (KETJEN Black 600JD) were added and dispersed for 1 hour by means of a paint shaker, subsequently to which was added 60 parts by weight of isocyanate, and dispersed for 3 minutes by means of a paint shaker. This dispersed liquid was placed in the centrifugal forming machine following the formation of the surface layer, and hardening was conducted by means of drying for 1 hour at a rotor rotation rate of 1,000 RPM and a temperature within the rotor of 120° C., thus laminating a base layer. Next, aging was conducted for 2 hours at a temperature of 80° C., following which the formed material was allowed to cool to room temperature. The formed item was then removed from the forming machine and the edges thereof were cut off, thereby obtaining an intermediate transfer member.

The obtained intermediate transfer member exhibited a surface layer of 150 μm in thickness, a base layer of 800 μm in thickness, a length of 250 mm, friction coefficient on the inner side of the belt of 0.47, hardness of 92, and a volume resistance value in the direction of thickness of $10^{10}$ Ω·cm.

Evaluation of this intermediate transfer member was conducted in the same manner as with Example 12. The results thereof are shown in Table 8.

EXAMPLE 18

An intermediate transfer member was prepared in the same manner as with Example 12, except that no lubricating layer was provided, and that silicone-grafted urethane was used for the base layer.

(Formation of the base layer)

100 parts by weight of silicone-grafted urethane and 10 parts by weight of conductive carbon (KETJEN Black 600JD) were added and dispersed for 1 hour by means of a paint shaker. This dispersed liquid was placed in the centrifugal forming machine following the formation of the surface layer, and hardening was conducted by means of drying for 1 hour at a rotor rotation rate of 1,000 RPM and a temperature within the rotor of 120° C., thus laminating a base layer. Next, aging was conducted for 2 hours at a temperature of 80° C., following which the formed material was allowed to cool to room temperature. The formed item was then removed from the forming machine and the edges thereof were cut off, thereby obtaining an intermediate transfer member.

The obtained intermediate transfer member exhibited a surface layer of 150 μm in thickness, a base layer of 800 μm in thickness, a length of 250 mm, friction coefficient on the inner side of the belt of 0.56, hardness of 90, and a volume resistance value in the direction of thickness of $10^{10}$ Ω·cm.

Evaluation of this intermediate transfer member was conducted in the same manner as with Example 12. The results thereof are shown in Table 8.

COMPARATIVE EXAMPLE 4

An intermediate transfer member was prepared in the same manner as with Example 1, except that no lubricating layer was provided.

The obtained intermediate transfer member exhibited a surface layer of 150 μm in thickness, a base layer of 800 μm in thickness, a length of 250 mm, friction coefficient on the inner side of the belt of 3.2, and a volume resistance value in the direction of thickness of $10^{10}$ Ω·cm.

Evaluation of this intermediate transfer member was conducted in the same manner as with Example 12. The results thereof were that shifting of the intermediate transfer member according to the Comparative Example 4 was marked to the extent that the endurance test was repeatedly stopped in order to correct the shifting and resume testing. Following the testing, the edges of the intermediate transfer member were stretched in a wave-like manner, and there were torn portions observed. The toner offset observed by microscope was 120 μm, and color reproduction was poor. However, no hollowing occurred. The results thereof are shown in Table 8.

TABLE 8

| | Friction Coefficient | Shifting | Hollowing | Layering Offset (μm) |
|---|---|---|---|---|
| Example 12 | 0.31 | None | None | 25 |
| Example 13 | 0.35 | None | None | 30 |
| Example 14 | 0.42 | None | None | 25 |
| Example 15 | 0.33 | None | None | 35 |
| Example 16 | 0.68 | None | None | 40 |
| Example 17 | 0.47 | None | None | 35 |
| Example 18 | 0.56 | None | None | 40 |
| Comparative Example 4 | 3.2 | Marked shifting | None | 120 |

What is claimed is:

1. An intermediate transfer member for electrophotography, comprising:

a base layer; and a surface layer provided upon said base layer, wherein said base layer is formed of elastomer, and said surface layer is formed of engineering plastic, and wherein the hardness measured from the side of said surface layer is in the range of 40 degrees to 100 degrees.

2. An intermediate transfer member according to claim 1, wherein the hardness of said base layer is in the range of 40 degrees to 70 degrees.

3. An intermediate transfer member according to claim 1, wherein the tensile modulus of elasticity of said surface layer is 2,000 N/mm$^2$ or greater.

4. An intermediate transfer member according to claim 3, wherein said tensile modulus of elasticity is in the range of 2,000 to 10,000 N/mm$^2$.

5. An intermediate transfer member according to claim 1, wherein said elastomer is selected from the following group: polyurethane, chloroprene rubber, isoprene rubber, nitrile rubber, and styrene-butadiene rubber; and said engineering plastic is selected from the following group: polyphenyl sulphone, polysulfone, polyether sulfone, polyester, polyacetal, polyarylate, polyamide, polycarbonate, polyphenylene ether, polyether imide, polyamidoimide, polyphenylene sulfide, and polyimide.

6. An intermediate transfer member according to claim 5, wherein said elastomer is polyurethane; and said engineering plastic is selected from the following group: polyphenyl sulphone, polysulfone, polyether sulfone, polyester, polyacetal, polyarylate, polyamide, and polycarbonate.

7. An intermediate transfer member according to claim 6, wherein said elastomer is polyurethane; and said engineering plastic is selected from the following group: polyphenyl sulphone, polyether sulfone, polyester, and polyamide.

8. An intermediate transfer member according to claim 1, wherein the volume resistivity of said intermediate transfer member in the direction of thickness is $10^5$ to $10^{12}$ Ω·cm.

9. An intermediate transfer member according to claim 8, wherein said volume resistivity is $10^8$ to $10^{10}$ Ω·cm.

10. An intermediate transfer member according to claim 1, wherein at least one of the said base layer or said surface layer contains a conductive filler.

11. An intermediate transfer member according to claim 1, wherein said surface layer contains lubricant.

12. An intermediate transfer member according to claim 1, further comprising a lubricating layer upon said surface layer.

13. An intermediate transfer member according to claim 1, wherein an inner surface of said intermediate transfer member has a friction coefficient of 0.7 or less.

14. An intermediate transfer member according to claim 13, wherein said friction coefficient is in the range of 0.1 to 0.7.

15. An intermediate transfer member according to claim 13, further comprising a lubricating layer having a friction coefficient of 0.7 or less.

16. An intermediate transfer member according to claim 13, wherein said base layer contains lubricant.

17. An electrophotographic apparatus comprising:

an electrophotographic photosensitive member;

charging means for charging said electrophotographic photosensitive member;

image exposure means for conducting image exposure to said electrophotographic photosensitive member, thereby forming an electrostatic latent image;

developing means for developing said electrostatic latent image and forming a toner image upon said electrophotographic photosensitive member; and an intermediate transfer member according to claim 1, to which said toner image is transferred.

18. An electrophotographic apparatus comprising:

an electrophotographic photosensitive member;

charging means for charging said electrophotographic photosensitive member;

image exposure means for conducting image exposure to said electrophotographic photosensitive member, thereby forming an electrostatic latent image;

developing means for developing said electrostatic latent image and forming a toner image upon said electrophotographic photosensitive member; and an intermediate transfer member for electrophotography to which said toner image is transferred, said intermediate transfer member including:

a base layer; and a surface layer provided upon said base layer, wherein said base layer is formed of elastomer, and said surface layer is formed of engineering plastic, and wherein the hardness measured from the side of said surface layer is in the range of 40 degrees to 100 degrees.

* * * * *

UNITED STATES PATENT AND TRADEMARK OFFICE

CERTIFICATE OF CORRECTION

PATENT NO. : 5,802,442

DATED : September 1, 1998

INVENTOR(S) : TAKUYA KONNO, ET AL.

It is certified that error appears in the above-identified patent and that said Letters Patent is hereby corrected as shown below:

COVER PAGE [30] FOREIGN APPLICATION PRIORITY DATA,
"Jul. 26, 1996 [JP] Japan...8-214965" should read --Jul. 29, 1996 [JP] Japan...8-214965--.

COLUMN 2,
Line 1, "While a" should read --A--.

COLUMN 3,
Line 63, "causes in high temperature" should read --is caused in high temperatures--.

COLUMN 5,
Line 14, "preferably" should read --preferable--.

COLUMN 6,
Line 31, "as"a" should read --as "a--; and
Line 49, "that:" should read --that--.

COLUMN 8,
Line 16, "provided" should read --providing--.

COLUMN 9,
Line 22, "(outter" should read --(outer--.

UNITED STATES PATENT AND TRADEMARK OFFICE

CERTIFICATE OF CORRECTION

PATENT NO. : 5,802,442

DATED : September 1, 1998

INVENTOR(S) : TAKUYA KONNO, ET AL.

It is certified that error appears in the above-identified patent and that said Letters Patent is hereby corrected as shown below:

COLUMN 14,
Line 43, "an" should read --a--.

COLUMN 16,
Line 31, "particules" should read --particles--;
Line 35, "a" should read --an--; and
Line 67, "Ω.heptane/xylene" should read
--n-heptane/xylene--.

COLUMN 20,
Delete lines 51-67.

COLUMNS 21 AND 22,
Delete lines 1-9 (Column 21) and lines 1-7 (Column 22) and replace as follows:

--17. An electrophotographic apparatus comprising:

an electrophotographic photosensitive member;

charging means for charging said electrophotgraphic photosensitive member;

image exposure means for conducting image exposure to said electrophotographic photosensitive member, thereby forming an electrostatic latent image;

UNITED STATES PATENT AND TRADEMARK OFFICE

CERTIFICATE OF CORRECTION

PATENT NO. : 5,802,442

DATED : September 1, 1998

INVENTOR(S) : TAKUYA KONNO, ET AL.

It is certified that error appears in the above-identified patent and that said Letters Patent is hereby corrected as shown below:

COLUMNS 21 AND 22 (Cont.), developing means for developing said electrostatic latent image and forming a toner image upon said electrophotographic photosensitive member; and an intermediate transfer member for electrophotography to which said toner image is transferred, said intermediate transfer member including:

a base layer; and a surface layer provided upon said base layer, wherein said base layer is formed of elastomer, and said surface layer is formed of engineering plastic, and wherein the hardness measured from the side of said surface layer is in the range of 40 degrees to 100 degrees.

18. An electrophotographic apparatus according to claim 17, wherein said toner image is formed by means of a plurality of toners, each of differing colors.--.

Signed and Sealed this

First Day of August, 2000

*Attest:*

*Attesting Officer*

Q. TODD DICKINSON

*Director of Patents and Trademarks*